United States Patent [19]

Ravinet et al.

[11] Patent Number: 4,607,145

[45] Date of Patent: Aug. 19, 1986

[54] ELECTROACOUSTIC TRANSDUCER WITH A PIEZOELECTRIC DIAPHRAGM

[75] Inventors: Pierre Ravinet, Bourg La Reine; Christian Claudepierre, Athis-Mons; Denis Guillou, Colombes; Francois Micheron, Gif Sur Yvette, all of France

[73] Assignee: Thomson-CSF, Paris, France

[21] Appl. No.: 586,449

[22] Filed: Mar. 5, 1984

[30] Foreign Application Priority Data

Mar. 7, 1983 [FR] France ..... 83 03697

[51] Int. Cl.[4] ..... H04R 17/00

[52] U.S. Cl. ..... 179/110 A

[58] Field of Search ..... 179/110 A, 111 E; 381/88; 310/322

[56] References Cited

U.S. PATENT DOCUMENTS

| | | | |
|---|---|---|---|
| 3,792,204 | 2/1974 | Murayama et al. | 179/110 A |
| 4,117,275 | 9/1978 | Miyanaga et al. | 179/111 E |
| 4,268,725 | 5/1981 | Nakagawa et al. | 179/110 A |
| 4,281,222 | 7/1981 | Nakagawa et al. | 179/110 A |
| 4,376,232 | 5/1983 | Martin | 179/110 A |
| 4,379,212 | 4/1983 | Martin | 179/110 A |

FOREIGN PATENT DOCUMENTS

| | | | |
|---|---|---|---|
| 0007436 | 7/1978 | European Pat. Off. . | |
| 72289 | 7/1982 | European Pat. Off. | 179/110 A |
| 0072288 | 2/1983 | European Pat. Off. . | |
| 85194 | 8/1983 | European Pat. Off. | 179/110 A |
| 2119912 | 11/1972 | Fed. Rep. of Germany | 179/110 A |
| 2119913 | 11/1972 | Fed. Rep. of Germany | 179/110 A |
| 2739735 | 3/1978 | Fed. Rep. of Germany . | |
| 2939479 | 4/1980 | Fed. Rep. of Germany . | |
| 2948034 | 6/1981 | Fed. Rep. of Germany . | |
| 3007773 | 9/1981 | Fed. Rep. of Germany . | |
| 65199 | 4/1971 | Luxembourg . | |
| 2059715 | 9/1979 | United Kingdom . | |
| 2104345 | 3/1983 | United Kingdom | 179/110 A |

OTHER PUBLICATIONS

*Electronics*, "Twinfilm Diaphragms Cancel Mike Noise", Mar. 2, 1978, vol. 51, No. 5, pp. 3E–4E.

Ultrasonics, vol. 14, No. 1, Jan. 1976, pp. 15–23, Guildford; N. Murayama et al: "The Strong Piezoelectricity in Polyvinylidene Fluoride (PVDF)".

*Primary Examiner*—Gene Z. Rubinson
*Assistant Examiner*—Danita R. Byrd
*Attorney, Agent, or Firm*—Oblon, Fisher, Spivak, McClelland & Maier

[57] ABSTRACT

A telephone transducer having a body and a spacer for securing a piezoelectric diaphragm and a printed circuit, wherein the body and the spacer are made with electrically conducting material to carry out the connections between the diaphragm and the printed circuit. The diaphragm can be made of polyvinylidene fluoride or polyvinylidene fluoride copolymer.

11 Claims, 12 Drawing Figures

ELECTROACOUSTIC TRANSDUCER WITH A PIEZOELECTRIC DIAPHRAGM

BACKGROUND OF THE INVENTION

The present invention relates to electroacoustic transducers making it possible to convert an acoustic pressure into an electrical voltage. It more specifically relates to microphones in which the conversion of an acoustic vibration into an electrical voltage is ensured by a piezoelectric polymer vibrating element.

A transducer of this type is filed in French Patent Application No. 81.15 506, filed by the Applicant Company on Aug. 11th 1981. This transducer uses an elastic structure in the form of an embedded plate having at least one inward curvature and which is covered on its two faces by electrodes connected to an impedance matching circuit. It is formed from a group of elements arranged in accordance with an original principle which give it excellent characteristics. However, the relatively large number of such elements and the assembly procedure are not suitable for the mass-production of transducers at high speed and low cost.

SUMMARY OF THE INVENTION

In order to obviate these disadvantages, the invention proposes an electroacoustic transducer having a minimum number of elements and making it possible to combine means ensuring the functions of housing or embedding the vibrating element internal and external connection, shielding, acoustic filtering and protection against moisture and dust.

The invention therefore relates to an electroacoustic transducer, whose vibrating element is constituted by a piezoelectric diaphragm subject to acoustic pressure on at least one of its faces, the faces of said structure being provided with electrodes forming a capacitor connected to an electric circuit arranged on a printed circuit, said diaphragm and said electric circuit being enclosed within a box or case, said transducer incorporating means for embedding said diaphragm, means for the electrical connection of said electrodes to said electric circuit and at least one low-pass acoustic filter, wherein said box or case is constituted by a tubular body, whose base is a perforated wall corresponding to the front face of the transducer, said body cooperating with a spacer in order to ensure the housing of the diaphragm, said body cooperating with said printed circuit to ensure the closure of the transducer and the position of the spacer, the electrical connection means being assured by the body and the spacer, the wall and the diaphragm defining a space forming said filter.

The invention also relates to a process for producing such a transducer, wherein its assembly is held in position by the mechanical connection between the body and the printed circuit, this connection pressing the spacer onto the diaphragm.

BRIEF DESCRIPTION OF THE DRAWINGS

The invention is described in greater detail hereinafter to non-limitative embodiments and with reference to the attached drawings, wherein show.

DETAILED DESCRIPTION OF THE PREFERRED EMBODIMENTS

Figure 1:
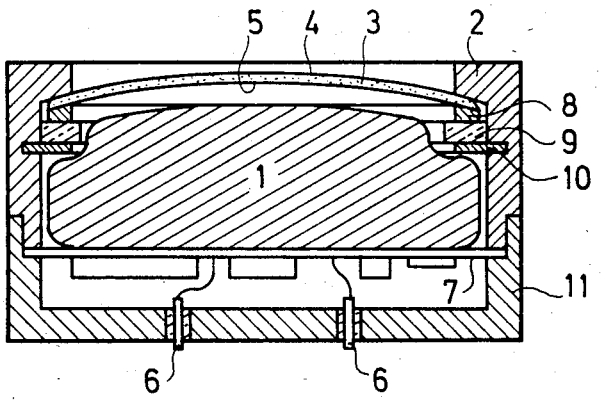
FIG. 1 PRIOR ART
FIG. 1 a meridian sectional view of a known microphone capsule.

FIG. 1 is a meridian sectional view of a microphone capsule with a piezoelectric plate according to the prior art. It is formed by a box or case having a metal upper part 2, which is fitted into the base of box or case 11, provided with insulated connecting terminals 6. A piezoelectric plate 3 provided with metal coatings 4 and 5 is embedded in truncated conelike manner between the edge of the upper part 2 of the case and a metal ring 8 having a trapezoidal section. Ring 8 is pressed against plate 3 by an insulating washer 9 resting on an elastic locking member 10, which penetrates a circular slot in the upper part 2 of the case. A pad 1 of acoustic absorbing material is placed in the central recess of the upper part 2 of the case. This pad is jammed between member 9 and a printed circuit board 7 on which are arranged the electronic components of an impedance matching circuit.

The microphone capsule according to the invention must satisfy the following requirements:

the piezoelectric diaphragm provided with electrodes on its two faces must be forced into a recess, which means that it must have a planar or convex shape, the contacts of these electrodes must be connected to electronic circuits installed in the capsule, the capsule must be enclosed in a conducting envelope ensuring its shielding, the capsule must integrate acoustic components such as cavities or orifices, which contribute to the shaping of the frequency response, the capsule must be provided with means for the electrical connection with external signal processing circuits, the capsule production process must be compatible with the constraints of automatic assembly procedures for a rate of at least 1000 capsules per hour.

Figure 2:
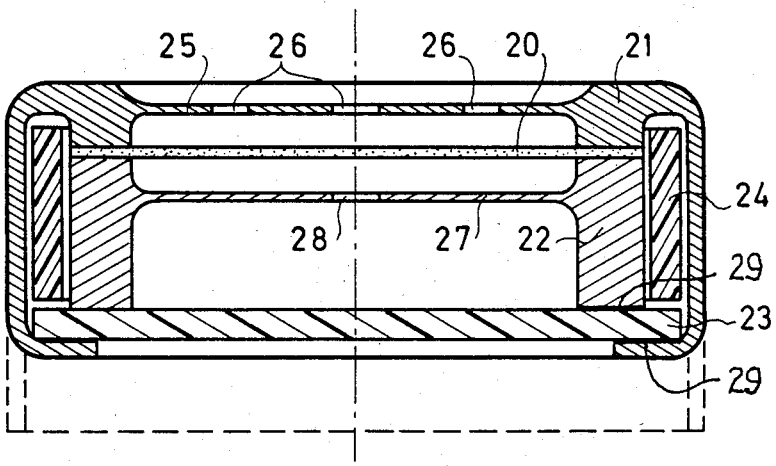
FIG. 2 a meridian sectional view of a capsule according to the invention.

FIG. 2 is a meridian sectional view of a capsule according to the invention. The piezoelectric diaphragm 20 is shown flat and the recess is also shown flat. However, it could also have another shape, e.g. convex, and can be held in position by a non-planar housing, or can be gripped between blades. Apart from the diaphragm, the capsule has four other parts which, in combined manner, ensure the aforementioned mechanical, acoustic and electric functions. Diaphragm 20 is secured between body 21 and spacer 22. Its two faces are covered with metal coatings acting as electrodes. The housing also ensures contacting between the electrodes of the diaphragm and the metal parts 21, 22 which are e.g. made from aluminium and, apart from their shielding function, provide the electrical connection between the diaphragm and the double-faced printed circuit 23. The annular casing 24 insulates body 21 from spacer 22. The inner face of printed circuit 23 can take welded electronic components constituting a preamplifier, whilst its outer face carries pins making it possible to connect the capsule to a connecting cable. Thus, the diaphragm and the inner electronic circuit are completely shielded by the equipotential envelope constituted by the outer electrode of the diaphragm, body 21 and the outer face of printed circuit 23.

As shown in FIG. 2, body 21 and space 22 can be advantageously used for defining, on either side of the diaphragm, cavities and perforated walls able to synthesize acoustic components able to bring about regularity of the response curve of the microphone. These acoustic components are materialised by wall 25 of body 21, said wall being perforated by holes 26, and by wall 27 of spacer 22, said wall being perforated by hole 28. In the case where the diaphragm is made from piezoelectric polymer parts 21 and 22 can have a housing profile able to obviate the mechanical effects due to significant temperature variations.

The assembly of the capsule described relative to FIG. 2 is greatly facilitated by the fact that symmetry of revolution is maintained throughout. The relative positioning of the various parts constituting the capsule is ensured by their stacking and their concentricity. It its lower part, body 21 initially has the tubular geometry indicated by dotted lines. The following is the order of the assembly operations. The body firstly receives the annular insulating casing 24, which then permits the centering of diaphragm 20 and spacer 22. The printed circuit 23 with its welded components is then fitted, the components being located in the interior of the capsule. The stack and housing are secured by crimping body 21 to the outer face of the printed circuit.

The metal parts 21 and 22 are suitable for industrial production by the so-called shock extrusion process. This process is widely used for producing pharmaceutical tablet tubes. It is therefore advantageous to make these parts from aluminium and to make them undergo an anti-corrosion chemical treatment. The insulating casing 24 is preferably made from a plastic material having a low dielectric constant, so as to reduce to the minimum the stray capacitance between the body and the spacer. It can be obtained by cutting up an extruded tube or by injection and moulding.

Printed circuit 23 can be of the copper-epoxy resin or copper on synthetic resin type, the tracks of the circuit being obtained by chemical etching or screen process printing. Apart from the perforations necessary for the installation of the components or external connection pins, a small supplementary orifice (e.g. approx. 0.5 mm) can be provided there so as to ensure a balancing leak of the static pressure between the two faces of the diaphragm. It should be noted that the idea of the double-faced oriented circuit must be understood here in its widest sense and that it can be extended to any structure consisting of an insulating substrate between two systems of electrodes having a geometry adapted to the desired connections. Thus, the outer electrode can be constituted by a metal foil engaged with the bare face of a single-faced printed circuit and fixed by crimping the body. As a result of microcutting, followed by 90° bending or folding, said foil can be directly provided with studs ensuring the connection with the copper-coated, etched face of the circuit, or with tongues serving as external connection pins. A flexible printed circuit (copper strip on polymer film, e.g. in accordance with the registered trade mark Terphane) engaged on an insulating substrate can be used as the inner face of the printed circuit. The interest of these variants is that they mainly lead to a less costly subassembly than a true double-faced printed circuit.

Figure 3:
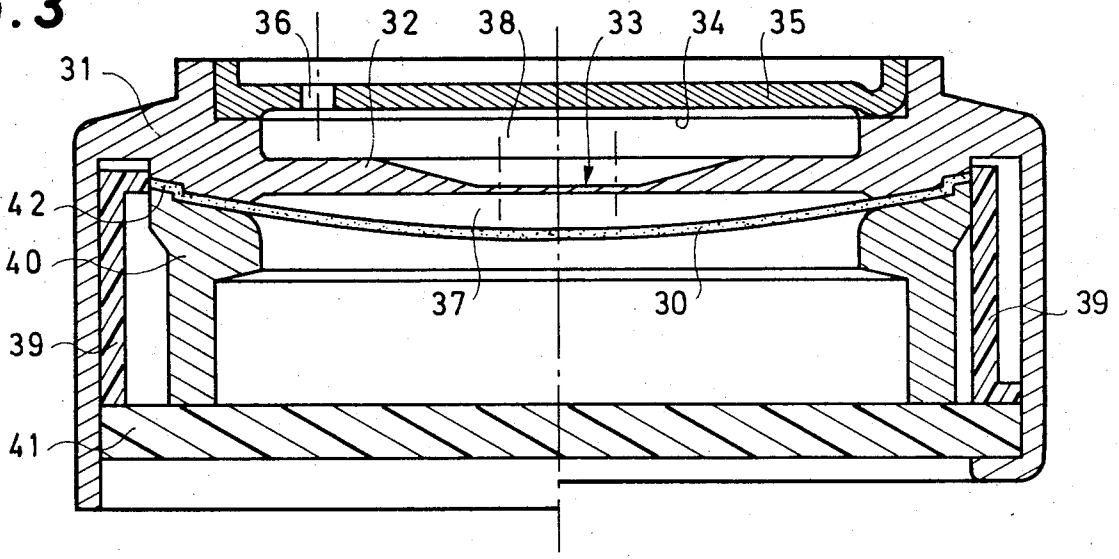
FIG. 3 a meridian sectional view of a microphone capsule according to the invention.

FIG. 3 is an embodiment of a microphone capsule according to the invention. The capsule uses a piezoelectric diaphragm 30, e.g. made from polyvinylidene fluoride ($PVF_2$), whose main faces are provided with electrodes, which can consist either of a polymer coating filled with conductive particles, or a metal deposit (preferably of the three-coating type, e.g. chrome-aluminium-chrome). It is also possible to use a diaphragm made from polymer combinations of $PVF_2$ copolymers. Body 31 comprises a wall 32 having acoustic components contributing to the shaping of the capsule response curve. They are arranged on the front face of the capsule and serve the double function of low-pass filtering and damping the resonance of the diaphragm, by an appropriate combination of cavities and orifices and by utilizing an acoustic resistor in the form of a covered, microperforated region 33 of wall 32. The cavity 37 defined by this wall and the diaphragm must be of very small volume, so that the concavity of the diaphragm is turned in such a way that an increase in its sag by thermal expansion leads to no risk of contact with said wall. A very thin, acoustically transparent polymer film 34 (e.g. polyethylene terephthalate for capacitors, thickness 6 micrometers) protects the microphone against the introduction of dust or droplets and prevents clogging of the microperforated acoustic resistor. This film is peripherally gripped in a shoulder of body 31 by a force-fitted stamped cap 35. This cap has orifices 36 and defines a new cavity 38, which constitutes a second low-pass filter, placed upstream of that linked with the microperforated resistor. It also helps to ensure the cutting off of the response of the microphone beyond 5 KHz. The capsule also has a metal spacer 40, the double-faced printed circuit 41 and the insulating casing 39.

Figure 4:
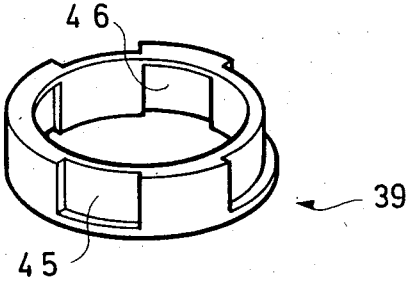
FIG. 4 a perspective view of an insulating casing.

FIG. 4 is a perspective view of the insulating casing. Its lateral surface has a profile which, by its recesses, makes it possible to reduce by approximately 50% the stray capacitance between body 31 and spacer 40. FIG. 4 shows outer recesses 45, which alternate with inner recesses 46. Other forms can be envisaged with the same advantages. It is generally advantageous for this part to have a notched form which, whilst ensuring the centering of the diaphragm and the spacer at the time of assembly, gives rise to a limited stray capacitance, due to the layers of air which it introduces between the body and the spacer.

Another design detail of this microphone relates to the static pressure balancing leak at the rear of the diaphragm. Instead of making a hole through the complete printed circuit, it is possible to make radial capillary leaks breaking the seal of the spacer and the body crimped onto the printed circuit. The etching on the two faces of the circuit is such that air passages 29 are created in the thickness of the copper layer of the printed circuit. Thus, the rear cavity of the microphone is connected to atmospheric pressure. These capillary leaks have a sufficiently high acoustic impedance to not disturb the microphone response, even at low frequency. In the same way, by sealing breaks between the different parts of the assembly, it is possible to ensure atmospheric pressurization under high acoustic impedance of cavity 38.

The assembly of the microphone capsule described relative to FIG. 3 involves the shaping of the non-planar diaphragm and assembly by crimping.

A first way of giving the $PVF_2$ diaphragm a dome shape consists of stacking a flat diaphragm, e.g. obtained by cutting by means of a punch, with the other assembly parts and crimping the body in the manner to be described hereinafter. The type of diaphragm used in this microphone is sufficiently thick and consequently has a sufficiently high bending strength to ensure that the securing of the truncated cone-shaped housing produces a dome shape without angular points. This deformation is extremely difficult to analyze and model, because it is a hyperstatic mechanics problem. In order to obtain the profile associated with appropriate microphone sensitivity values, as well as the frequency of the first resonance mode of the diaphragm, it is consequently necessary to operate on a trial and error basis by studying several different assemblies relating e.g. to the thickness of the diaphragm and the housing or embedding angle. For information, it should be noted that 200 micrometer thick $PVF_2$ diaphragm shaped according to this process in the capsule shown in FIG. 3 has its first resonance mode at a frequency between 3600 and 4400 Hz, which is suitable for telephone applications.

During securing by crimping, the material yield strength is only exceeded at the periphery of the housing, where the polymer must adapt to the angular profile of the anchoring area. Thus, if the diaphragm is subsequently dismantled only this region will retain its shape, the central part of the dome losing its height, so that it will largely have a planar geometry. This shows that it is necessary to stabilize the shape of the embedded dome by relaxing the stresses therein. Therefore, a suitable heat treatment consists of placing the completely assembled microphone in an enclosure at 90° C. for 1 hour.

This process for shaping the diaphragm and assembling the microphone capsule has been described in an overall manner in the aforementioned French Patent Application. This process is particularly advantageous due to its simplicity, but still has certain limitations. Thus, if the housing or embedding angle is increased beyond a certain value of approximately 7°, it leads to a highly aspherical shape, instead of to an increase in the dome height. Thus, this process does not make it possible to obtain very convex spherical or aspherical shapes, i.e. whose height to diameter ratio exceeds 0.03.

However, a large convexity of the diaphragm is advantageous if a high microphone sensitivity stability is desired for operating at temperatures below ambient temperature. Thus, due to the great differential expansion between the polymer diaphragm and the metal housing parts, a reduction in the temperature leads to a radial contraction of the diaphragm, so that its height is reduced, followed by the appearance of a radial tension, when the diaphragm geometry approaches flatness. In this second phase, the microphone sensitivity suddenly drops. This situation occurs in the case of a temperature dropping in proportion to the initial great convexity of the diaphragm, because the initial height determines the arc length provision which the diaphragm can absorb by moving towards the chord plane before its contraction starts to stiffen it.

Figure 5:
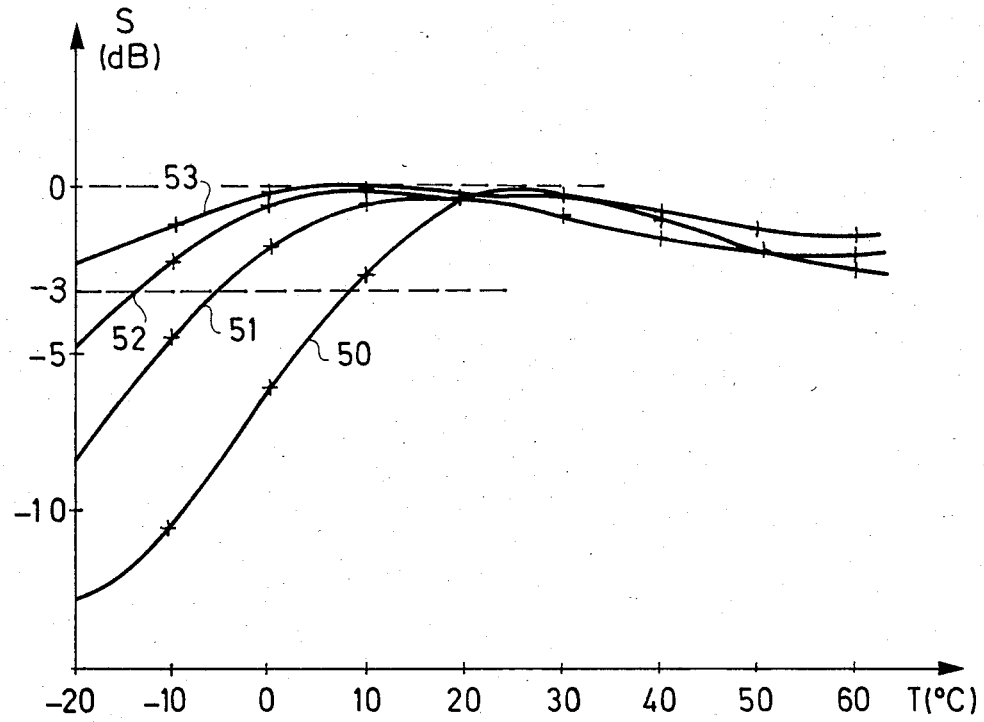
FIG. 5 an explanatory graph.

FIG. 5 is an explanatory graph showing the influence of the height to diameter ratio on the microphone sensitivity, as a function of the temperature. The temperature T in degrees Celsius is plotted on the abscissa and the sensitivity S in decibels is plotted on the ordinate, as a function of the parameter H/D at 20° C. (H representing the height and D the diameter of the non-embedded diaphragm part). Curve 50 was plotted for H/D=0.020, curve 51 for H/D=0.024, curve 52 for H/D=0.027 and curve 53 for H/D=0.039. It can be seen from this graph that the ratio H/D=0.039 (rounded to 0.04) assures that the variation of the sensitivity between −20° C. and +20° C. are lower than 3 db. The conditions of shaping the diaphragm and the housing must be such that the ratio H/D is at least equal to 0.04 at ambient temperature. There are several ways in which this can be brought about.

The diaphragm can be force-fitted into the casing. It is firstly cut to a diameter larger by a fraction of a percent than the internal diameter of the casing. Thus, the insertion of the diaphragm into the casing brings about its convexity, its concavity being directed by pressure of the capsule body on the spacer. After fixing, the height of the diaphragm exceeds that which would be obtained with a diaphragm freely entering the casing.

Another method consists of cold crimping, which involves treating the problem by the cause which has produced it, namely the differential expansion between the housing and the diaphragm. It simply consists of fixing the diaphragm by crimping at a temperature below ambient temperature. On return to ambient temperature, the reverse effect of that described hereinbefore occurs, the diaphragm expanding to obtain a height exceeding that resulting from shaping by embedding alone. With regards to the capsule shown in FIG. 3, a crimping temperature just above 0° C. to prevent icing is appropriate for subsequently obtaining a microphone sensitivity stable at ±0.5 dB between −5° and +35° C. and reduced by approximately 3 dB at −20° C. The performance of this method presupposes that the automatic crimping bench for the capsule is enclosed in a cabin kept at the crimping temperature and that the preassembled capsules which are ready to be crimped have stayed there for a sufficient time to thermally condition them.

Figure 6:
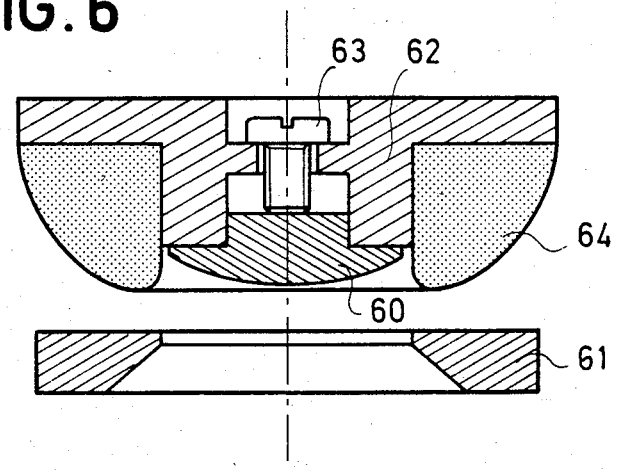
FIG. 6 a sectional view of a punch.

A final method for obtaining the desired shape consists of inserting a non-planar, pre-shaped diaphragm into the assembly. To this end, a diaphragm can be cut beforehand in the shape of a non-planar disk, followed by the thermoforming thereof in a mould having a suitable geometry, after which it is crimped in its housing. This process has the disadvantage of introducing a supplementary operation between the cutting of the diaphragm and the assembly of the capsule. This preforming or preshaping operation can be integrated into the cutting operation with the aid of a tool like that shown in FIG. 6. The latter shows a punch, whose heating, spherical forming die 60 is able to impose the desired shape on a piezoelectric polymer film by means of mould 61. The forming die 60 is fixed to a punching die 62 by screws 63. The side or edge presser 64 prevents the film from sliding during the operation, cutting taking place after the forming operation. Member 64 is, for example, shaped like a paraboloid in its part which is in contact with the film and can be made from a material marketed under the registered trade mark ELADIP. The difference compared with the thermoforming of a previously cut disk is that the film undergoes overstretching, which should be made irreversible so as to subsequently ensure the shape stability of the embedded diaphragm. This means that the precutting thermoforming has to be carried out at a high temperature of 90° to 100° C., which is also compatible with the thermal stabilization temperature of the material in the form of a strip or plate and carried out beforehand at 110° to 120° C.

Figure 7:
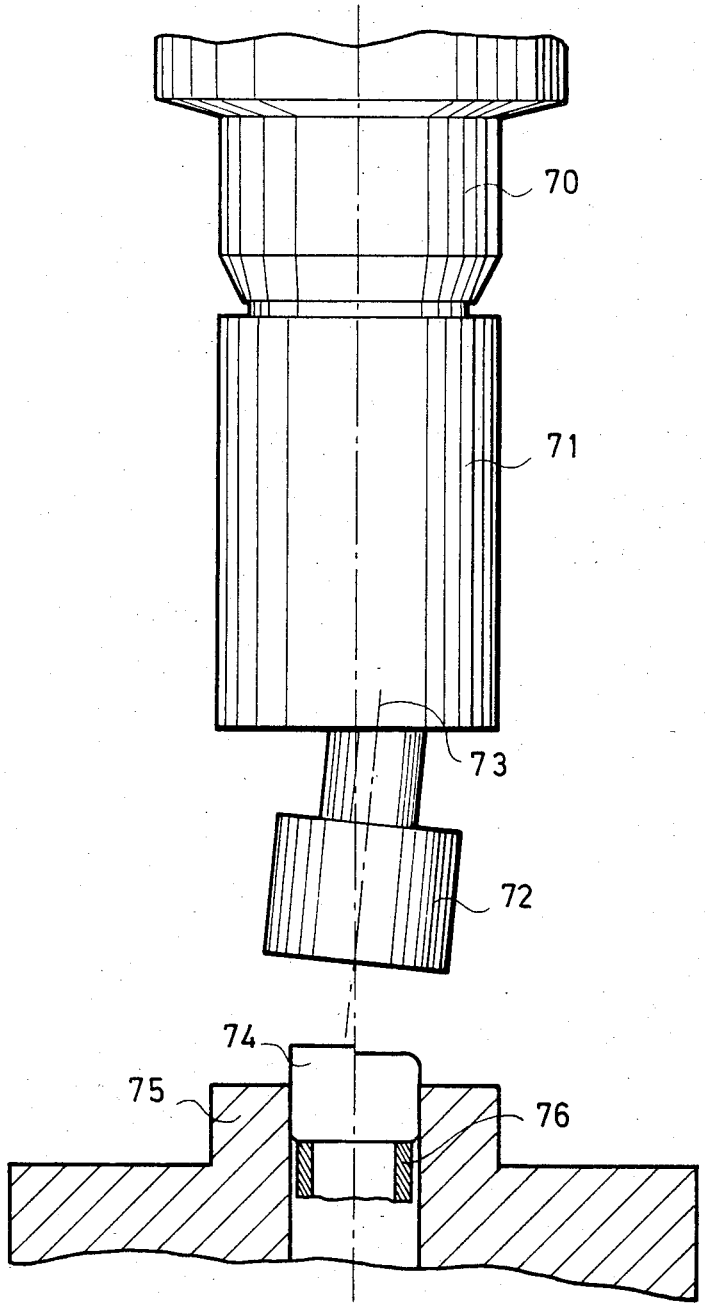
FIG. 7 a view of a snapping device.

A suitable procedure for crimping the capsule body after preassembly of the parts by stacking consists of a rotary snapping using the tool shown in FIG. 7, whose main axis coincides with that of the capsule. It comprises a mandrel 70, which rotates the body 71 of the tool supporting snapping device 72. The axis of the latter does not coincide with the main axis of the tool. The capsule, whereof only body 74 can be seen, is placed in a support 75 of an abutment. The mandrel rotation speed is a few hundred revolutions per minute. The snapping device is also rotated and is progressively lowered. It first tangentially comes into contact with the vertical lip of the capsule body along one of its generatrixes in order to make it adopt a rounded profile. The rotation axis 73 of the snapping device describes a cone around the main axis of the tool. After about 10 revolutions, the lip is finally completely turned down and secures the stack of parts by bearing on the printed circuit. The complete operation takes a few seconds, including the insertion of the preassembled capsule into the support and its ejection after crimping.

In the general description of the capsule, as in the embodiment, the body and the spacer are made from metal. This choice of material, although well suited to the functions to be performed by these parts and the production processes, is not however limitative. Thus, the same general transducer structure can be used when making one or more of these parts from a plastic material. The choice of an appropriate material is mainly guided by the requirement of a very good mechanical and thermal behaviour. In particular, an excellent creep strength is necessary to ensure a good stability of the stack of parts after fixing. This leads to the choice of a material having a creeping point temperature which is well above the highest temperature to which the transducer can be exposed.

If the body and the spacer of the capsule are made from plastic, the problem of their electrical conductivity can be considered in two ways. A volume conductivity can be obtained by means of filling said parts with carbon black. The conductivity of the thus filled material is very low compared with that of metals, but is adequate in the application to microphones. Thus, as the input impedance of the preamplifier is approximately a few $10^6\Omega$, resistors of approximately 10 to 100 $k\Omega$ in series with the diaphragm are perfectly acceptable. If a higher conductivity is required, such as in the case of a transmitting transducer, a surface conduction can also be envisaged by coating the parts in question. The choice of their constituent material is then guided by its suitability for receiving a conductive coating. The coating can be obtained by varnishing, vacuum metallization of a chemical process. Metallization of the outer lateral surface of the spacer can be prevented by a masking process. It is then possible to eliminate the insulating casing so that the stray capacitance between the body and the spacer can be further reduced. The outer surface of the capsule body can be coated with a conductive coating serving as a shield.

Figure 8:
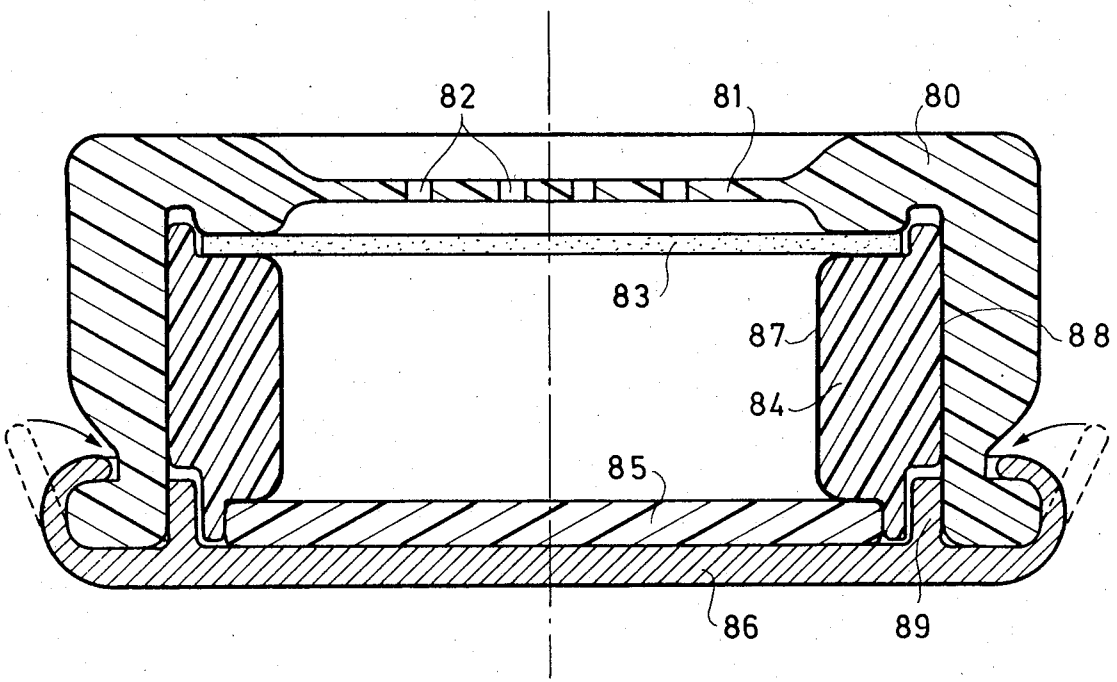
FIGS. 8 and 9 meridian sectional views of microphone capsules according to the invention.

The assembly of the capsule by snapping can be retained if a forgeable plastic material is used. However, this fixing and assembly process is generally better adapted to metals than to plastics. FIG. 8 is a meridian sectional view of a capsule having a body and a spacer made from moulded plastic, whose crimping is effected by milling. It is possible to see a body 80 having a wall 81, perforated by holes 82. The diaphragm 83 is peripherally secured between body 80 and spacer 84. Printed circuit 85 is engaged against the spacer by metal part 86 acting as an outer electrode for the printed circuit. Part 86, e.g. obtained by extrusion, is crimped by milling onto the body, in the manner indicated by the arrow in FIG. 8. The body and the spacer receive surface conductive coatings 87, 88, which ensure the electrical connections between the faces of the diaphragm and the printed circuit, either directly, or by means of metal part 86. The effect of the crimping is on the one hand to produce a diametral fixing ensuring the contact between the conductive coating 88 on shoulder 89 of part 86 and on the other hand to axially secure the stack and ensure an effective housing of the diaphragm. Other capsule assembly procedures are possible by taking advantage of the suitability of plastic materials for bonding or welding, specifically by ultrasonics.

Examples of plastics materials satisfying the various criteria of mechanical and thermal behaviour and strength, the suitability of receiving a conductive charge for a conductive coating, reference can be made to reinforced or non-reinforced phenylene polycarbonate and phenylene polyoxides, modified by means of polystyrene or polyacrylonitrile. In order to produce the body and the spacer from these materials, use can be made of moulding or injection procedures. The use of plastic materials is particularly appropriate in the case where it is necessary to bring about a maximum reduction of the differential expansion between the diaphragm and its embedding or housing jaws.

Piezoelectric diaphragm transmitting transducers such as telephone receivers, loudspeakers or vibrators can also be designed in accordance with the present invention. In this case, the printed circuit can merely serve as a support for connection, but it can also carry electronic components, as in the case of microphones, so that if necessary a signal generator or amplifier can be integrated into the capsule. The acoustic components monolithically forming part of the body or spacer can be adapted to the considered application, particularly in the form of resonators or acoustic horns.

The capsule according to the invention is very suitable for the use of viscoelastic materials in contact with the diaphragm, in order to obtain acoustic filtering and damping means. These materials are able to fill cavities defined by the body and the spacer. A foam or elastomer cushion can e.g. be assembled to the other parts. It is also possible to consider injecting into the cavities after assembly a quantity of a resin undergoing a considerable volume expansion on polymerization, e.g. a foam marketed under the registered trade mark RHODORSIL.

Such processes can be used as damping means in an airborne transducer, but also make it possible to extend the invention to the encapsulation of submarine piezoelectric transducers. In such devices, the filling of the cavities adjacent to the diaphragm with an appropriate material (e.g. a polyurethane resin) is able to ensure one or more of the following functions: sealing, acoustic impedance matching, resistance of the diaphragm to the action of high hydrostatic pressures, etc.

Figure 9:
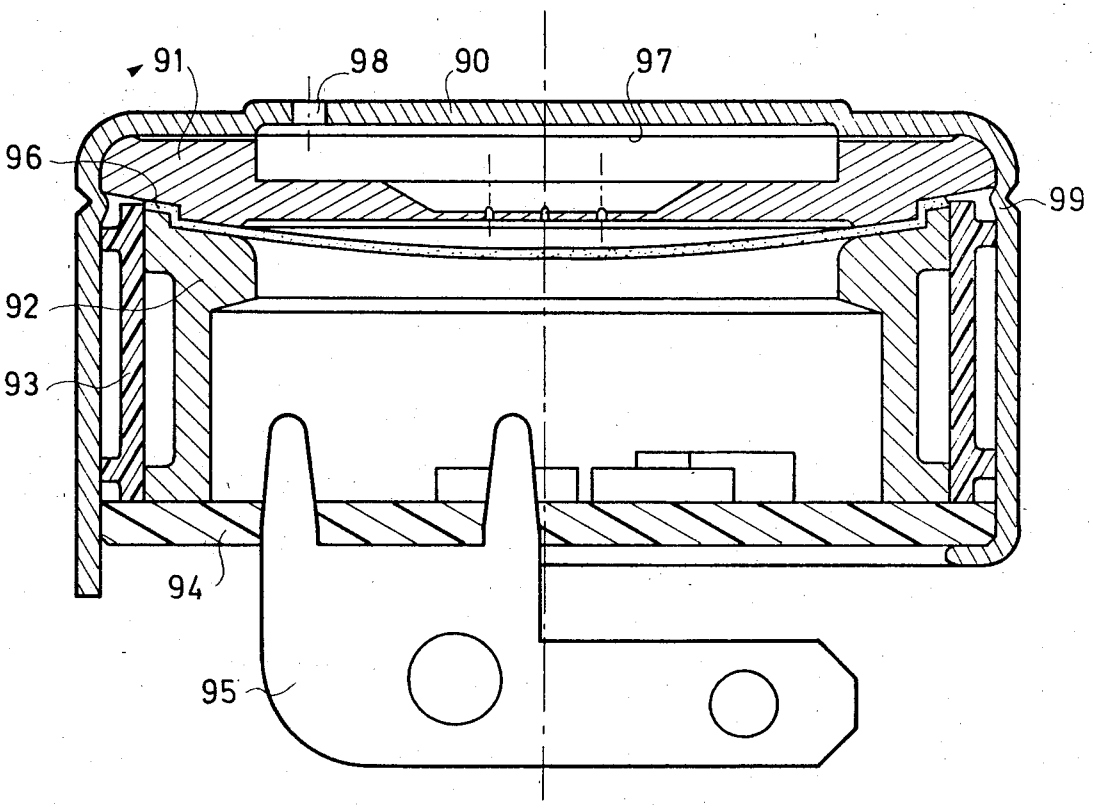

FIG. 9 is a meridian sectional view of a microphone capsule according to a variant of the invention. It differs from the capsule of FIG. 3 through the presence of a ring located in front of the actual capsule. It comprises a body 90, a front embedding ring 91, a spacer 92, an insulating casing 93, a printed circuit 94 supporting electronic components and to which are fixed output sleeves or lugs such as 95. Diaphragm 96 is embedded between ring 91 and the spacer. There is a protective film 97 between body 90 and ring 91. The body is perforated on the front face of the capsule by holes 98. It is precrimped by milling along a circumference 99 on the embedding ring. This precrimping contributes to the securing of the protective film and ensures the electrical connection between the electrode on the front face of the diaphragm and the rear face of the printed circuit. The spacer ensures the electrical connection between the electrode on the rear face of the diaphragm and the internal face of the printed circuit. The body, ring and spacer must consequently be electrically conductive. The shaping of the frequency response is ensured by cavities and orifices in ring 91. This device permits an easier mechanical construction of the body compared with that of FIG. 3, the embedding ring having better made shaft angles and the protective film is better fixed.

Figure 10:
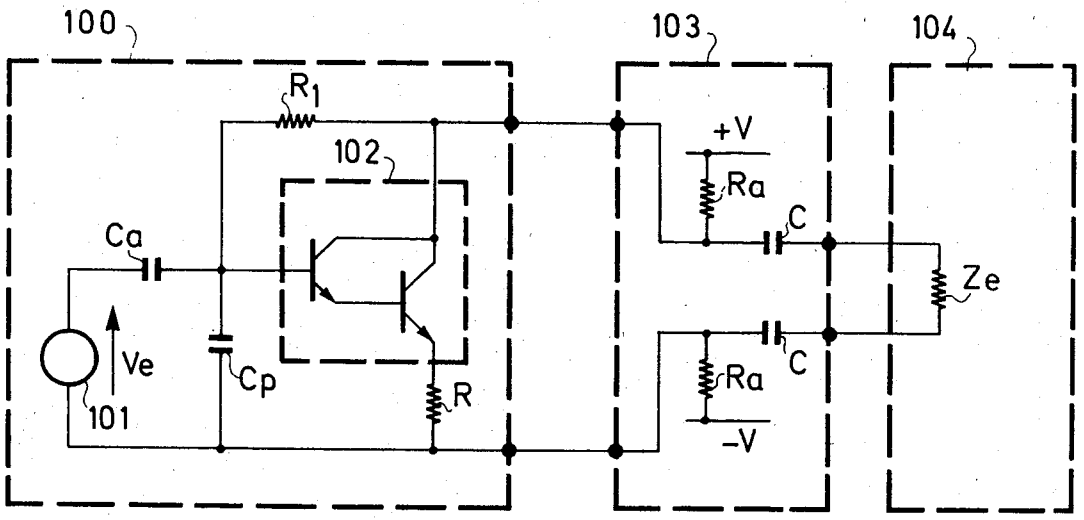
FIG. 10 a circuit diagram of a microphone preamplifier.

FIG. 10 is a possible diagram of the microphone preamplifier, circuit 100 corresponding to the microphone capsule. The voltage Ve supplied by the diaphragm is symbolized by the voltage generator 101, in which Ca is its active capacitance (approx. 83 pF) and Cp the stray capacitance of the capsule (approx. 64 pF). Circuit 102 is a DARLINGTON circuit in the form of a microbox or microcase, $R_1$ being a resistor of about $10^7\Omega$ and R a variable resistor. Circuit 100 is connected by a connecting cable to a station for processing the signal incorporating a supply circuit 103 and a transmission circuit 104. Circuit 103 makes it possible to supply d.c. voltage (+V, −V) to circuit 100 by means of resistors Ra (approx. 3 kΩ). It also makes it possible to transmit the signal from the capsule via connecting capacitances C to the transmission circuit 104, whereof only the input impedance Ze is shown and which is generally approximately 100 to 200Ω. Resistor R can be adjusted from outside the capsule by a hole made in the printed circuit. This adjustment can take place with a laser beam.

Figure 11:
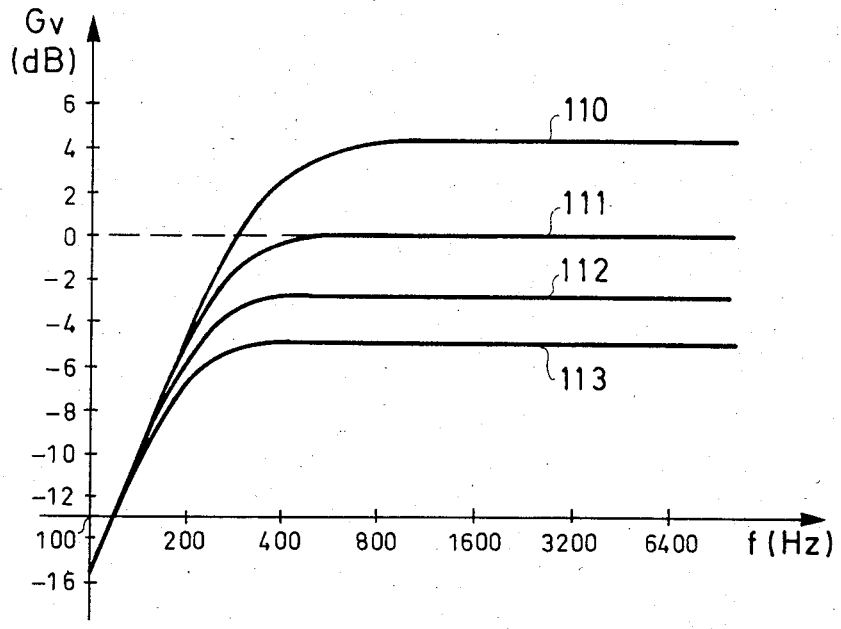
FIGS. 11 and 12 explanatory graphs.

The frequency response of the preamplifier is a function of the values given to resistor R and impedance Ze. FIG. 11 is a graph showing the influence of resistor R on the gain of the preamplifier Gv=Vs/Ve (Vs being its output voltage) as a function of the frequency f. This graph has been plotted for Ze=200Ω and for four values of R: R=100Ω (curve 110), R=200Ω (curve 111), R=300Ω (curve 112), R=400Ω (curve 113). The ordinate axis was calibrated by taking as the origin decibels Gv=0.43. It is apparent from FIG. 11, that the gain Gv reduces when R increases. The temperature coefficient of resistor R can advantageously be chosen so as to bring about a compensation of the sensitivity variation of the diaphragm with temperature.

Figure 12:
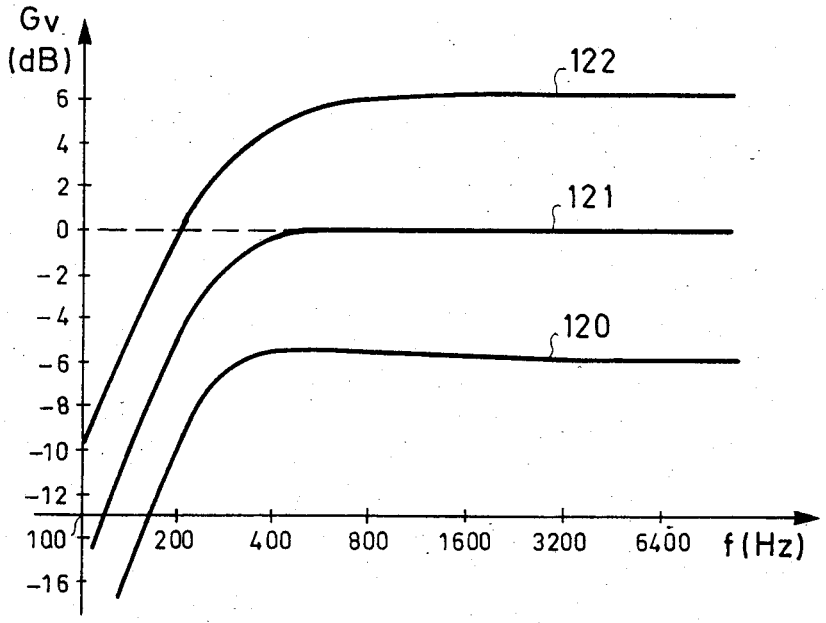

FIG. 12 is a graph showing the gain Gv as a function of the frequency f with the input impedance parameter Ze. The graph was plotted for R=200Ω and for three values of Ze: Ze=100Ω (curve 120), Ze=200Ω (curve 121) and Ze=430Ω (curve 122). The ordinate axis is calibrated by taking as the origin decibels Gv=0.43. It is apparent from FIG. 12 that the gain Gv increases when Ze increases. The graphs of FIGS. 11 and 12 indicate the possibility of a compromise between the gain of the capsule with its preamplifier and the low cutoff frequency of the microphone system.

It falls within the scope of the invention to apply the microphone capsule structure to the most general cases of flat or non-flat, mineral or polymer piezoelectric diaphragm microphones, which are embedded or secured by any other fixing means between jaws. The invention is also applicable to the case of transducers functioning as transmitters.

What is claimed is:

1. An electroacoustic transducer comprising:

a piezoelectric diaphragm having two faces;

electrode means formed on each of said face of said piezoelectric diaphragm for forming a capacitor;

a printed circuit board having an electric circuit means positioned on one side and connecting means on the other side;

an electrically conductive spacer means having a wall;

a conductive crimping body having an orificed wall for encasing and housing said piezoelectric diaphragm, said electrically conductive spacer means such that the wall of said electrically conductive spacer is positioned substantially parallel to said orifice wall of said crimping body, with said piezoelectric diaphragm positioned therebetween, thereby defining the space between said spacer and said piezoelectric diaphragm as a first acoustic area and further defining a second acoustic area as being the space between said crimping body and said piezoelectric diaphragm and wherein said second acoustic space operates as a low-pass acoustic filter; and embedding means coupled with said piezoelectric diaphragm, said electrically conductive spacer and said printed circuit board for electrically connecting the electrode means, formed on said piezoelectric diaphragm, to said electric circuit means.

2. An electroacoustic transducer according to claim 1, wherein said piezoelectric diaphragm is made from a polymer or a polymer combination.

3. An electroacoustic transducer according to claim 2, wherein said piezoelectric diaphragm is made of polyvinylidene fluoride or a polyvinylidene fluoride copolymer.

4. An electroacoustic transducer according to claim 1, wherein said crimping body and said electrically conductive spacer are made from metal.

5. An electroacoustic transducer according to claim 1, which further comprises:

an insulating casing made from a material having a low dielectric constant, said casing ensuring the electrical insulation of said conductive crimping body and said spacer.

6. An electroacoustic transducer according to claim 5, wherein said insulating casing has peripheral recesses.

7. An electroacoustic transducer according to claim 1, wherein the printed circuit has at least one orifice ensuring a static pressure balancing leak between the two faces of the printed circuit.

8. An electroacoustic transducer as in claim 1 wherein said diaphragm is positioned in said crimping body in a convex shape.

9. An electroacoustic transducer as in claim 8, wherein as H is defined as the height of said diaphragm and D is defined as the portion of said diaphragm not in contact with said spacer the relationship of $H/D \geqq 0.4$ being satisfied.

10. An electroacoustic transducer as in claim 1, wherein said embedding means is made of plastic.

11. An electroacoustic transducer according to claim 10, wherein the plastic material has a glass transition temperature exceeding the maximum temperature of use of the transducer.

* * * * *